US010460668B2

(12) United States Patent
Li et al.

(10) Patent No.: US 10,460,668 B2
(45) Date of Patent: Oct. 29, 2019

(54) PIXEL COMPENSATION METHOD, PIXEL COMPENSATION APPARATUS AND DISPLAY APPARATUS

(71) Applicant: BOE Technology Group Co., Ltd., Beijing (CN)

(72) Inventors: Yongqian Li, Beijing (CN); Xuehuan Feng, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/968,856

(22) Filed: May 2, 2018

(65) Prior Publication Data

US 2019/0066590 A1 Feb. 28, 2019

(30) Foreign Application Priority Data

Aug. 29, 2017 (CN) ..... 2017 1 0757113

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2320/0209* (2013.01); *G09G 2320/0233* (2013.01); *G09G 2320/0295* (2013.01); *G09G 2320/045* (2013.01)

(58) Field of Classification Search
None
See application file for complete search history.

(56) References Cited

U.S. PATENT DOCUMENTS

| | | | | |
|---|---|---|---|---|
| 9,747,831 | B2 * | 8/2017 | Park | G09G 3/006 |
| 2016/0042710 | A1 * | 2/2016 | Xu | G09G 3/3677 345/100 |
| 2018/0308414 | A1 * | 10/2018 | Kang | G09G 3/3614 |
| 2018/0322829 | A1 * | 11/2018 | Xie | G09G 3/3258 |
| 2018/0337687 | A1 * | 11/2018 | Adjiwibawa | H03M 1/662 |

* cited by examiner

*Primary Examiner* — Duane N Taylor, Jr.
(74) *Attorney, Agent, or Firm* — Westman, Champlin & Koehler, P.A.

(57) ABSTRACT

The embodiments of the present application relate to a pixel compensation method, a pixel compensation apparatus and a display apparatus. In blanking periods of two adjacent display frames, detection lines for various color sub-pixels to be compensated in a $(2n-1)^{th}$ row and a $(2n)^{th}$ row are charged respectively, wherein a non-zero grayscale is input to one of the $(2n-1)^{th}$ row and the $(2n)^{th}$ row and a zero grayscale is input to the other one. Voltages on the detection lines for the various color sub-pixels to be compensated in the rows to which the non-zero grayscale and the zero grayscale are input are detected respectively, and a detected voltage of each color sub-pixel to be compensated in the row to which the non-zero grayscale is input is obtained according to voltages on detection lines for color sub-pixels in the $(2n-1)^{th}$ row and the $(2n)^{th}$ row and belonging to the same column.

19 Claims, 5 Drawing Sheets

PIXEL COMPENSATION METHOD, PIXEL COMPENSATION APPARATUS AND DISPLAY APPARATUS

CROSS-REFERENCE TO RELATED APPLICATION(S)

This application claims priority to the Chinese Patent Application No. 201710757113.X, filed on Aug. 29, 2017, which is incorporated herein by reference in its entirety.

TECHNICAL FIELD

The present application relates to the field of display technologies, and more particularly, to a pixel compensation method, a pixel compensation apparatus, and a display apparatus.

BACKGROUND

Electroluminescent diodes such as Organic Light Emitting Diodes (OLEDs), Quantum Dot Light Emitting Diodes (QLEDs) etc. are hot spots in electroluminescent display panels. Pixel circuits are generally used in the electroluminescent display panels to drive the electroluminescent diodes to emit light. As the usage time increases, driving transistors in the pixel circuits may suffer from conditions such as aging etc. This results in a shift in threshold voltages and mobility of the driving transistors, thereby causing a difference in display brightness.

SUMMARY

According to an aspect according to the embodiments of the present application, there is provided a pixel compensation apparatus of a display panel, comprising a controller configured to:

control, in blanking periods of two adjacent display frames, charging of detection lines for various color sub-pixels to be compensated in a $(2n-1)^{th}$ row and a $(2n)^{th}$ row in the display panel respectively and detect voltages on various detection lines after the charging is performed, where n is a positive integer; wherein the charging comprises inputting a data voltage of non-zero grayscale to each color sub-pixel to be compensated in one of the $(2n-1)^{th}$ row and the $(2n)^{th}$ row, and inputting a data voltage of zero grayscale to each color sub-pixel to be compensated in the other of the $(2n-1)^{th}$ row and the $(2n)^{th}$ row;

determine a detected voltage of each color sub-pixel to be compensated in the row to which the non-zero grayscale is input according to the detected voltages on detection lines for color sub-pixels to be compensated in the $(2n-1)^{th}$ row and the $(2n)^{th}$ row and belonging to the same column; and compensate for each color sub-pixel to be compensated in the row to which the non-zero grayscale is input in a next display frame according to the detected voltage.

In an example, each sub-pixel comprises a pixel circuit and a light emitting device connected to the pixel circuit, and the pixel circuit is connected to a corresponding detection line; and the controller is further configured to control the pixel circuit to input the data voltage of non-zero grayscale to the color sub-pixel to be compensated in the $(2n-1)^{th}$ row to charge a detection line connected to the pixel circuit.

In an example, the controller is further configured to calculate a voltage difference between the detected voltages on the detection lines for the color sub-pixels to be compensated in the $(2n-1)^{th}$ row and the $(2n)^{th}$ row and belonging to the same column, and determine the detected voltage of each color sub-pixel to be compensated in the $(2n-1)^{th}$ row according to the calculated voltage difference.

In an example, each sub-pixel comprises a pixel circuit and a light emitting device connected to the pixel circuit, and the pixel circuit is connected to a corresponding detection line; and the controller is further configured to control the pixel circuit to input the data voltage of non-zero grayscale to the color sub-pixel to be compensated in the $(2n)^{th}$ row to charge a detection line to which the pixel circuit is connected.

In an example, the controller is further configured to calculate a voltage difference between the detected voltages on the detection lines for the color sub-pixels to be compensated in the $(2n-1)^{th}$ row and the $(2n)^{th}$ row and belonging to the same column, and determine the detected voltage of each color sub-pixel to be compensated in the $(2n)^{th}$ row according to the calculated voltage difference.

In an example, the display panel comprises a red sub-pixel, a green sub-pixel, and a blue sub-pixel, and the controller is configured to compensate for one of the red sub-pixel, the green sub-pixel, and the blue sub-pixel respectively.

In an example, the display panel comprises a red sub-pixel, a green sub-pixel, a blue sub-pixel, and a white sub-pixel, and the controller is configured to compensate for one of the red sub-pixel, the green sub-pixel, the blue sub-pixel, and the white sub-pixel respectively.

In an example, the controller is configured to compensate for the red sub-pixel, the green sub-pixel, and the blue sub-pixel in sequence.

In an example, the controller is configured to compensate for the red sub-pixel, the green sub-pixel, the blue sub-pixel, and the white sub-pixel in sequence.

According to another aspect according to the embodiments of the present application, there is provided a display apparatus, comprising the pixel compensation apparatus according to the embodiments of the present application.

According to another aspect according to the embodiments of the present application, there is provided a pixel compensation method of a display panel, comprising:

charging, in blanking periods of two adjacent display frames, detection lines for various color sub-pixels to be compensated in a $(2n-1)^{th}$ row and a $(2n)^{th}$ row in the display panel respectively and detecting voltages on various detection lines after the charging is performed, where n is a positive integer; wherein the charging comprises inputting a data voltage of non-zero grayscale to each color sub-pixel to be compensated in one of the $(2n-1)^{th}$ row and the $(2n)^{th}$ row, and inputting a data voltage of zero grayscale to each color sub-pixel to be compensated in the other of the $(2n-1)^{th}$ row and the $(2n)^{th}$ row;

determining a detected voltage of each color sub-pixel to be compensated in the row to which the non-zero grayscale is input according to the detected voltages on detection lines for color sub-pixels to be compensated in the $(2n-1)^{th}$ row and the $(2n)^{th}$ row and belonging to the same column; and compensating for each color sub-pixel to be compensated in the row to which the non-zero grayscale is input in a next display frame according to the detected voltage.

In an example, each sub-pixel comprises a pixel circuit and a light emitting device connected to the pixel circuit, and the pixel circuit is connected to a corresponding detection line; and charging detection lines for various color sub-pixels to be compensated in a $(2n-1)^{th}$ row and a $(2n)^{th}$ row comprises:

controlling a pixel circuit in each color sub-pixel to be compensated in the $(2n-1)^{th}$ row to input the data voltage of non-zero grayscale to the color sub-pixel to be compensated in the $(2n-1)^{th}$ row.

In an example, determining a detected voltage of each color sub-pixel to be compensated in the row to which the non-zero grayscale is input comprises: calculating a voltage difference between the detected voltages on the detection lines for the color sub-pixels to be compensated in the $(2n-1)^{th}$ row and the $(2n)^{th}$ row and belonging to the same column, and determining the detected voltage of each color sub-pixel to be compensated in the $(2n-1)^{th}$ row according to the calculated voltage difference.

In an example, each sub-pixel comprises a pixel circuit and a light emitting device connected to the pixel circuit, and the pixel circuit is connected to a corresponding detection line; and charging detection lines for various color sub-pixels to be compensated in a $(2n-1)^{th}$ row and a $(2n)^{th}$ row comprises: controlling a pixel circuit in each color sub-pixel to be compensated in the $(2n)^{th}$ row to input the data voltage of non-zero grayscale to the color sub-pixel to be compensated in the $(2n)^{th}$ row.

In an example, determining a detected voltage of each color sub-pixel to be compensated in the row to which the non-zero grayscale is input comprises: calculating a voltage difference between the detected voltages on the detection lines for the color sub-pixels to be compensated in the $(2n-1)^{th}$ row and the $(2n)^{th}$ row and belonging to the same column, and determining the detected voltage of each color sub-pixel to be compensated in the $(2n)^{th}$ row according to the calculated voltage difference.

In an example, the display panel comprises a red sub-pixel, a green sub-pixel, and a blue sub-pixel, and the method comprises: compensating for one of the red sub-pixel, the green sub-pixel, and the blue sub-pixel respectively.

In an example, the display panel comprises a red sub-pixel, a green sub-pixel, a blue sub-pixel, and a white sub-pixel, and the method comprises: compensating for one of the red sub-pixel, the green sub-pixel, the blue sub-pixel, and the white sub-pixel respectively.

In an example, the red sub-pixel, the green sub-pixel, and the blue sub-pixel are compensated in sequence.

In an example, the red sub-pixel, the green sub-pixel, the blue sub-pixel, and the white sub-pixel are compensated in sequence.

DETAILED DESCRIPTION

In order to make the purposes, technical solutions and advantages of the present application more clear, specific implementations of a pixel compensation method, a pixel compensation apparatus, and a display apparatus according to the embodiments of the present application will be described in detail below with reference to the accompanying drawings. It should be understood that the preferred embodiments described below are only used to illustrate and explain the embodiments of the present application and are not used to limit the embodiments of the present application. The embodiments in the present application and the features in the embodiments can be combined with each other without conflict.

Figure 1:
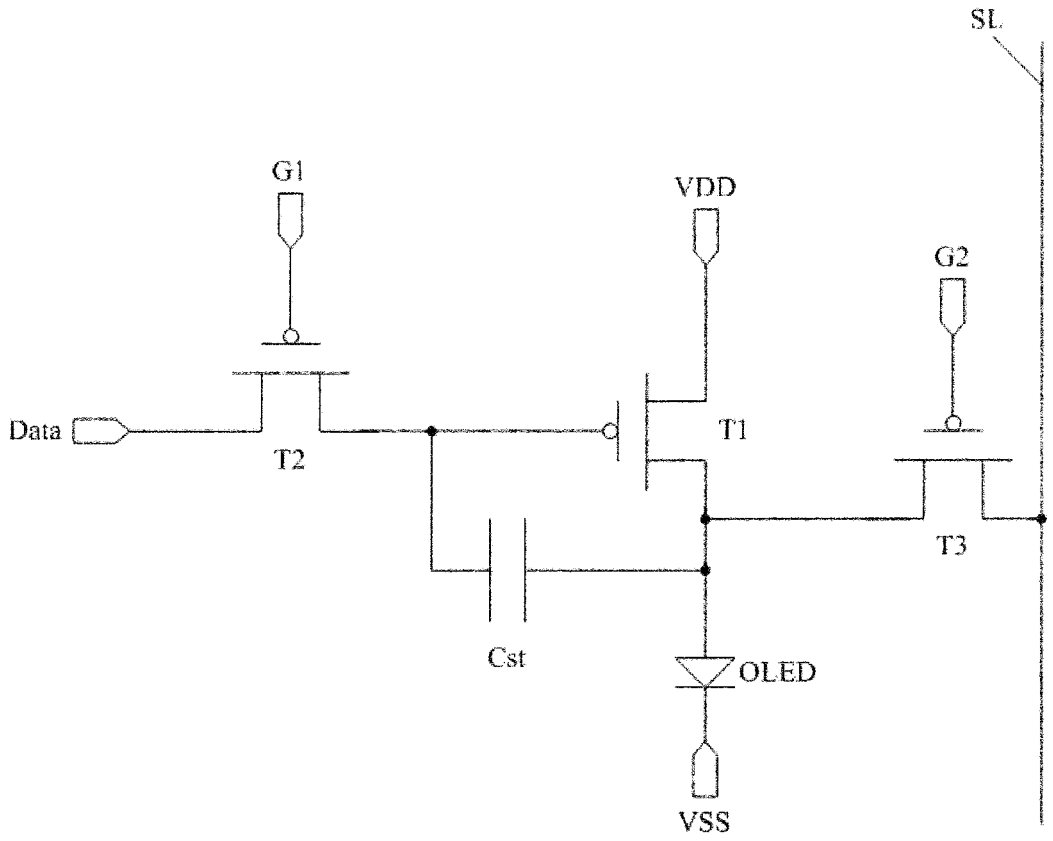
FIG. 1 is a structural diagram of a pixel circuit.

FIG. 1 illustrates a diagram of a pixel circuit. As shown in FIG. 1, the pixel circuit may comprise a driving transistor T1, a switch transistor T2, and a storage capacitor Cst. The pixel circuit controls the switch transistor T2 to be turned on to write a data voltage at a data signal terminal Data to a gate of the driving transistor T1, so as to control the driving transistor T1 to generate operating current to drive an electroluminescent diode L to emit light. However, as the usage time increases, the driving transistor T1 may suffer from conditions such as aging etc. This causes a shift in a threshold voltage and mobility of the driving transistor T1, thereby resulting in a difference in display brightness. In order to ensure the display quality, the threshold voltage and the mobility of the driving transistor may be compensated by external compensation. As shown in FIG. 1, a detection line SL may be provided in a display panel and a detection transistor T3 connected to a drain of the driving transistor T1 may be provided in the pixel circuit. When one row of pixels in the electroluminescent display panel is compensated, a pixel circuit in each sub-pixel in the row is controlled to charge a corresponding detection line SL, a voltage on each detection line is detected, and compensation calculation is performed according to the detected voltage, to obtain a data voltage for display of each sub-pixel in the row. However, as the electroluminescent display panel also has a variety of signal lines, there is coupling capacitance between the detection line and other signal lines. Due to the effect of the coupling capacitance, the signal of the detection line may change when a screen is switched in the display panel. This results in an inaccurate detected voltage on the detection line, thereby leading to an inaccurate data voltage obtained by the compensation calculation and affecting the display effect.

Figure 2A:
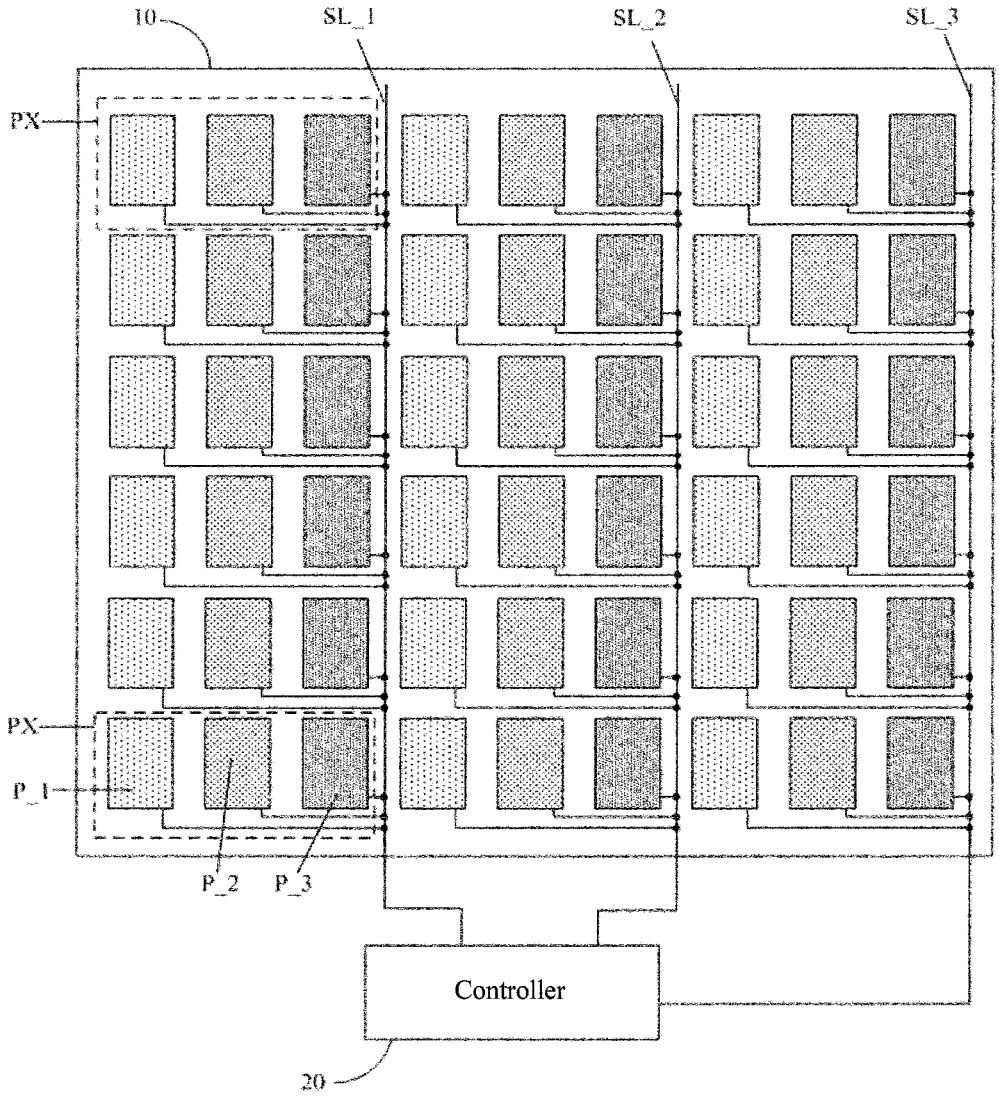
FIG. 2*a* is an exemplary structural diagram of a pixel compensation apparatus according to an embodiment of the present application.
Figure 2B:
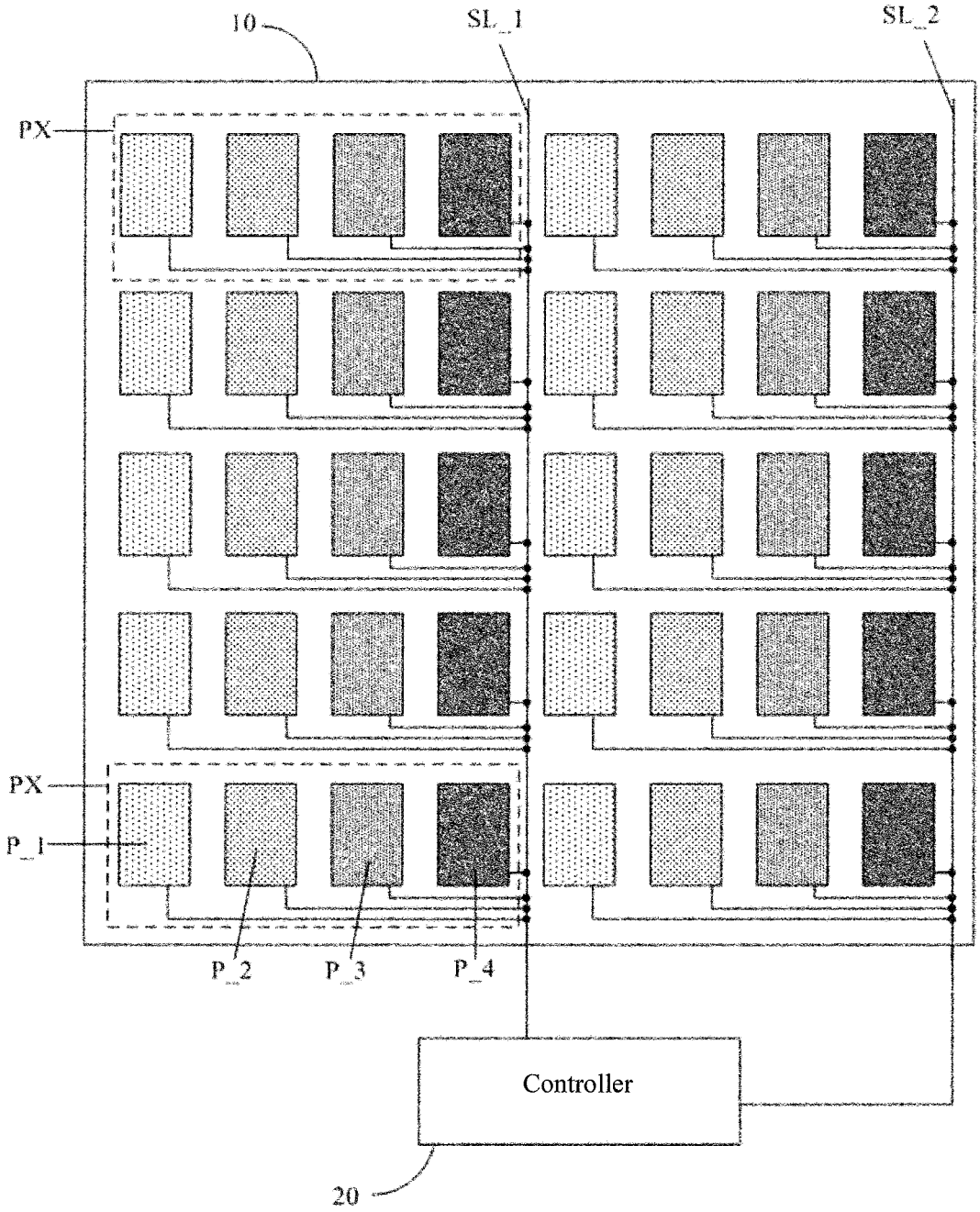
FIG. 2*b* is another exemplary structural diagram of a pixel compensation apparatus according to an embodiment of the present application.

The embodiments of the present application provide a pixel compensation method. The pixel compensation method can compensate for pixels in a display panel. As shown in FIG. 2*a* and FIG. 2*b*, for example, sub-pixels in a display panel 10 in FIG. 2*a* have three colors, and sub-pixels in the display panel 10 in FIG. 2*b* have four colors. The display panel 10 comprises a plurality of pixels PX and a plurality of detection lines SL_k, where k=1, 2, 3, . . . K, and K is a total number of columns of pixels in the display panel 10. One detection line is provided for each column of pixels, each pixel PX comprises a plurality of sub-pixels P_m having different colors, where m=1, 2, 3 . . . M, and M is a total number of colors of the sub-pixels in the display panel 10, and various sub-pixels P_m belonging to the same pixel PX may be connected to the same detection line.

Figure 3:
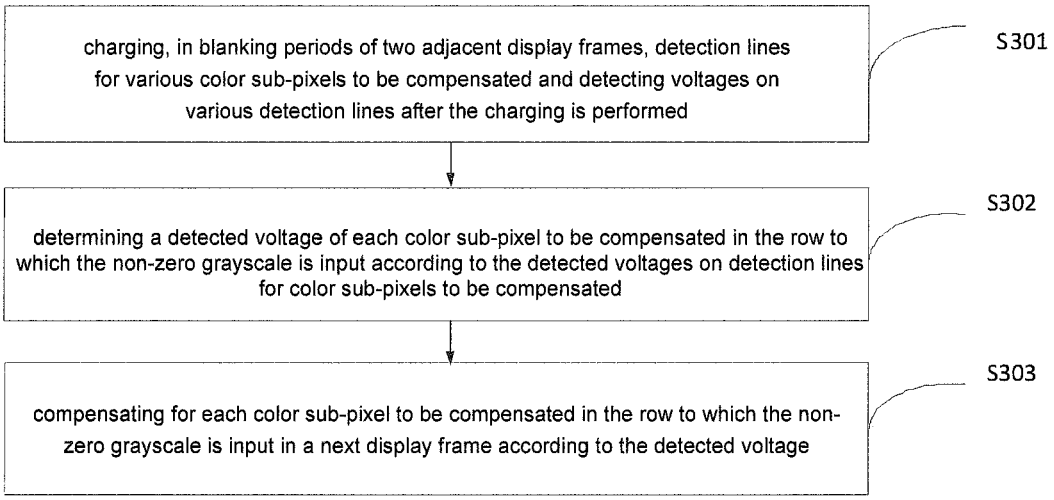
FIG. 3 is a flowchart of a compensation method according to an embodiment of the present application.

As shown in FIG. 3, the pixel compensation method according to the embodiments of the present application may comprise the following steps.

In step S301, detection lines for various color sub-pixels to be compensated in a $(2n-1)^{th}$ row and a $(2n)^{th}$ row in the display panel are charged in blanking periods of two adjacent display frames respectively and voltages on various detection lines after the charging is performed are detected, where n is a positive integer; wherein the charging comprises inputting a data voltage of non-zero grayscale to each color sub-pixel to be compensated in one of the $(2n-1)^{th}$ row and the $(2n)^{th}$ row, and inputting a data voltage of zero grayscale to each color sub-pixel to be compensated in the other of the $(2n-1)^{th}$ row and the $(2n)^{th}$ row.

In step S302, a detected voltage of each color sub-pixel to be compensated in the row to which the non-zero grayscale is input is determined according to the detected voltages on detection lines for color sub-pixels to be compensated in the $(2n-1)^{th}$ row and the $(2n)^{th}$ row and belonging to the same column.

In step S303, each color sub-pixel to be compensated in the row to which the non-zero grayscale is input is compensated in a next display frame according to the detected voltage.

According to the pixel compensation method according to the embodiments of the present application, in a blanking period of a first display frame of two adjacent display frames, a data voltage of non-zero grayscale is input to each color sub-pixel to be compensated in, for example, the $(2n-1)^{th}$ row, so that an additional detected voltage $V_0$ is applied to a detection line for each color sub-pixel to be compensated in the $(2n-1)^{th}$ row. In this way, a detected voltage on the detection line for each color sub-pixel to be compensated in the $(2n-1)^{th}$ row is substantially a sum of the detected voltage $V_0$ and a coupling voltage $\Delta V$ caused by the coupling action, i.e., $V_0+\Delta V$. In a blanking period of a second display frame of the two adjacent display frames, a data voltage of zero grayscale is input to each color sub-pixel to be compensated in, for example, the $(2n)^{th}$ row. Therefore, a detection line for each color sub-pixel to be compensated in the $(2n)^{th}$ row is not charged with the additional detected voltage $V_0$. In this way, a detected voltage on the detection line for each color sub-pixel to be compensated in the $(2n)^{th}$ row is only the coupling voltage $\Delta V$. Thus, the detected voltage V0 of each color sub-pixel to be compensated in the $(2n-1)^{th}$ row may be obtained according to the voltages on the detection lines for the color sub-pixels to be compensated in the $(2n-1)^{th}$ row and the $(2n)^{th}$ row and belonging to the same column. Similarly, in a blanking period of a first display frame of two adjacent display frames, a data voltage of zero grayscale is input to each color sub-pixel to be compensated in, for example, the $(2n-1)^{th}$ row, and in a blanking period of a second display frame of the two adjacent display frames, a data voltage of non-zero grayscale is input to each color sub-pixel to be compensated in, for example, the $(2n)^{th}$ row. In this way, the detected voltage $V_0$ of each color sub-pixel to be compensated in the $2n^{th}$ row may be obtained. Therefore, the detected voltage $V_0$ of each color sub-pixel to be compensated in the row to which the non-zero grayscale is input can be obtained, so that the influence of the coupling action on the detected voltage $V_0$ can be eliminated, and the accuracy of the detected voltage of each color sub-pixel to be compensated can be improved. Thereby, the problem of inaccurate data voltage obtained by compensation calculation due to a voltage change on the detection line caused by the coupling effect can be improved, horizontal stripes appearing in a screen can be eliminated, and the screen display effect can be improved.

It should be illustrated that, during the scanning process of the display panel, the scanning may start from an upper left corner of an image and advance horizontally while a scanning point moves downwards. After a frame image is scanned, the procedure returns from a lower right corner of the image to the upper left corner of the image and starts to scan a new frame. There is a field blanking period before starting to scan a new frame. In the field blanking period, a data voltage for displaying the image is not transmitted. As no image is displayed in the field blanking period, signal detection and determination may be performed in this period. For example, a blanking period of a display frame may be a field blanking period in the display frame.

According to the embodiments of the present application, a sub-pixel of the display panel may comprise a pixel circuit and a light emitting device connected to the pixel circuit, and the pixel circuit is connected to a corresponding detection line. The light emitting device may be an organic light emitting diode or a quantum dot light emitting diode. Of course, the light emitting device may also be another type of electroluminescent diode capable of emitting light by itself, which is not limited herein.

For example, as shown in FIG. 1, the pixel circuit may comprise a driving transistor T1, a switch transistor T2, a detection transistor T3, and a storage capacitor Cst. The switch transistor T2 has a gate connected to a first scanning signal terminal G1, a source connected to a data signal terminal Data, and a drain connected to a gate of the driving transistor T1 and a first terminal of the storage capacitor Cst. The driving transistor T1 has a source connected to a high voltage power supply terminal VDD, and a drain connected to a second terminal of the storage capacitor Cst, a source of the detection transistor T3, and an anode of a light emitting device L, respectively. A cathode of the light emitting device L is connected to a low voltage power supply terminal VSS. The detection transistor T3 has a gate connected to a second scanning signal terminal G2, and a drain connected to a corresponding detection line.

For example, the display panel may implement image display using 64 grayscales, 256 grayscales, or 1024 grayscales. The 64 grayscales represent that there are 64 grayscale values, wherein 0 represents the lowest grayscale, i.e., a grayscale when the display panel displays the darkest screen, and 63 represents the highest grayscale, i.e., a grayscale when the display panel displays the whitest screen. The 256 grayscales represent that there are 256 grayscale values, wherein 0 represents the lowest grayscale, i.e., a grayscale when the display panel displays the darkest screen, and 255 represents the highest grayscale, i.e., a grayscale when the display panel displays the whitest screen. The 1024 grayscale represents that there are 1024 grayscale values, wherein 0 represents the lowest grayscale, i.e., a grayscale when the display panel displays the darkest screen, and 1023 represents the highest grayscale, i.e., a grayscale when the display panel displays the whitest screen. Therefore, when the display panel has 64 grayscales or 256 grayscales or 1024 grayscales, "non-zero grayscale" refers to grayscales other than 0.

For example, a data voltage of each color sub-pixel to be compensated in a display frame after the $(2n)^{th}$ display frame may be determined using a preset compensation algorithm according to the determined detected voltage of each color sub-pixel to be compensated in the row to which the non-zero grayscale is input.

The display panel may comprise N rows of sub-pixels, where N is an even number. Then, the $(2n-1)^{th}$ row is an odd-numbered row of sub-pixels, and the $(2n)^{th}$ row is an even-numbered row of sub-pixels, where $$n = 1, 2, 3, \ldots \frac{N}{2}.$$

For example, n=1, 2, and 3 when N=6; or n=1, 2, 3, 4, and 5 when N=10; and so on when n is equal to another value, which will not be repeated here.

For example, the compensation method according to the embodiments of the present application may be performed in a preset compensation phase of a preset compensation period. For example, when the display panel comprises N rows of sub-pixels, the preset compensation phase may comprise 2N consecutive display frames. In a blanking period of a $(2n-1)^{th}$ display frame in first N consecutive display frames of the 2N consecutive display frames, a data voltage of non-zero grayscale is input to each color sub-pixel to be compensated in a $(2n-1)^{th}$ row, and in a blanking period of a $(2n)^{th}$ display frame in the first N consecutive display frames, a data voltage of zero grayscale is input to each color sub-pixel to be compensated in a $(2n)^{th}$ row. In a blanking period of a $(2n-1)^{th}$ display frame in last N consecutive display frames of the 2N consecutive display frames, a data voltage of zero grayscale is input to each color sub-pixel to be compensated in the $(2n-1)^{th}$ row, and in a blanking period of a $(2n)^{th}$ display frame in the last N consecutive display frames, a data voltage of non-zero grayscale is input to each color sub-pixel to be compensated in the $(2n)^{th}$ row.

Alternatively, in the blanking period of the $(2n-1)^{th}$ display frame in the first N consecutive display frames of the 2N consecutive display frames, a data voltage of zero grayscale may be input to each color sub-pixel to be compensated in the $(2n-1)^{th}$ row, and in the blanking period of the $(2n)^{th}$ display frame, a data voltage of non-zero grayscale may be input to each color sub-pixel to be compensated in the $(2n)^{th}$ row. In the blanking period of the $(2n-1)^{th}$ display frame in the last N consecutive display frames of the 2N consecutive display frames, a data voltage of non-zero grayscale is input to each color sub-pixel to be compensated in the $(2n-1)^{th}$ row, and in the blanking period of the $(2n)^{th}$ display frame, a data voltage of zero grayscale is input to each color sub-pixel to be compensated in the $(2n)^{th}$ row.

For example, when sub-pixels having M colors are included in the display panel, compensation may be performed in compensation phases of which a number is the same as that of the colors. For example, when M=1, only one compensation phase may be included. When M=2, two compensation phases may be included, and display frames in the two compensation phases are consecutive, that is, a last display frame of a first compensation phase in the two compensation phases and a first display frame of a second compensation phase in the two compensation phases are consecutive. When M=3, three compensation phases may be included, and display frames in the three compensation phases are consecutive, that is, a last display frame of a first compensation phase in the three compensation phases and a first display frame of a second compensation phase in the three compensation phases are consecutive, and a last display frame of a second compensation phase in the three compensation phases and a first display frame of a third compensation phase in the three compensation phases are consecutive. When M=4, four compensation phases may be included, and display frames in the four compensation phases are consecutive, that is, a last display frame of a first compensation phase in the four compensation phases and a first display frame of a second compensation phase in the four compensation phases are consecutive, a last display frame of a second compensation phase in the four compensation phases and a first display frame of a third compensation phase in the four compensation phases are consecutive, and a last display frame of a third compensation phase in the four compensation phases and a first display frame of a fourth compensation phase in the four compensation phases are consecutive. When M is equal to another value, a relationship among the display frames may be deduced similarly, which will not be repeated here.

For example, according to the embodiments of the present application, the display panel may be a high resolution display panel. The high resolution may comprise 3840×2160, 1920×1080, etc., which is not limited here.

As shown in FIG. 2*a*, for example, the display panel may comprise a red sub-pixel P_1, a green sub-pixel P_2, and a blue sub-pixel P_3. For example, compensation may be performed for one of the red sub-pixel P_1, the green sub-pixel P_2, and the blue sub-pixel P_3, respectively. For example, threshold voltages of driving transistors in the sub-pixels may be compensated in sequence in an order of red, green, and blue. The threshold voltages of the driving transistors in the sub-pixels may also be compensated in sequence in an order of red, blue, and green. Alternatively, the threshold voltages of the driving transistors in the sub-pixels are compensated in sequence in an order of green, red, and blue. Of course, color sub-pixels to be compensated in the three preset color compensation phases may also be in an order other than the order of the red sub-pixel P_1, the green sub-pixel P_2, and the blue sub-pixel P_3, which will not be described in detail here.

As shown in FIG. 2*b*, for example, the display panel may comprise a red sub-pixel P_1, a green sub-pixel P_2, a blue sub-pixel P_3, and a white sub-pixel P_4. For example, four compensation phases arranged in order may be included, and each of the compensation phases corresponds to one of the red sub-pixel P_1, the green sub-pixel P_2, the blue sub-pixel P_3, and the white sub-pixel P_4. For example, threshold voltages of driving transistors in the sub-pixels may be compensated in sequence in an order of red, green, blue, and white. Alternatively, the threshold voltages of the driving transistors in the sub-pixels may also be compensated in sequence in an order of red, blue, green, and white. Alternatively, the color sub-pixels to be compensated in the four compensation phases may also be the green sub-pixel P_2, the red sub-pixel P_1, the blue sub-pixel P_3, and the white sub-pixel P_4 in sequence, so that the threshold voltages of the driving transistors in the sub-pixels may be compensated in sequence in an order of green, red, blue and white. Of course, the color sub-pixels to be compensated in the four color compensation phases may also be an order other than the order of the red sub-pixel P_1, the green sub-pixel P_2, the blue sub-pixel P_3, and the white sub-pixel P_4, which will not be described in detail here.

For example, a data voltage of non-zero grayscale may be input to each color sub-pixel to be compensated in the $(2n-1)^{th}$ row, and a data voltage of zero grayscale may be input to each color sub-pixel to be compensated in the $(2n)^{th}$ row. A pixel circuit in each color sub-pixel to be compensated in the $(2n-1)^{th}$ row and the $(2n)^{th}$ row is controlled in sequence to charge a detection line to which the pixel circuit is connected. As the non-zero grayscale corresponds to remaining screens except for the darkest screen, operating current may be generated by the driving transistor in the pixel circuit, and therefore a voltage charged by the data voltage of non-zero grayscale into the detection line connected to the pixel circuit through the pixel circuit is a detected voltage $V_0$. In this way, it can be ensured that an additional detected voltage $V_0$ can be input to the detection line for each color sub-pixel to be compensated in the $(2n-1)^{th}$ row. Further, as the zero grayscale corresponds to the darkest screen, the data voltage of zero grayscale generally does not cause the driving transistor in the pixel circuit to generate operating current, and therefore the voltage charged by the data voltage of zero grayscale into the detection line connected to the pixel circuit through the pixel circuit is 0V. In this way, it can be ensured that no additional detected voltage $V_0$ is input to the detection line for each color sub-pixel to be compensated in the $(2n)^{th}$ row.

For example, determining a detected voltage of each color sub-pixel to be compensated in the row to which the non-zero grayscale is input may comprise: calculating a voltage difference between the detected voltages on the detection lines for the color sub-pixels to be compensated in the $(2n-1)^{th}$ row and the $(2n)^{th}$ row and belonging to the same column, and determining the detected voltage of each color sub-pixel to be compensated in the $(2n-1)^{th}$ row according to the calculated voltage difference.

Figure 4A:
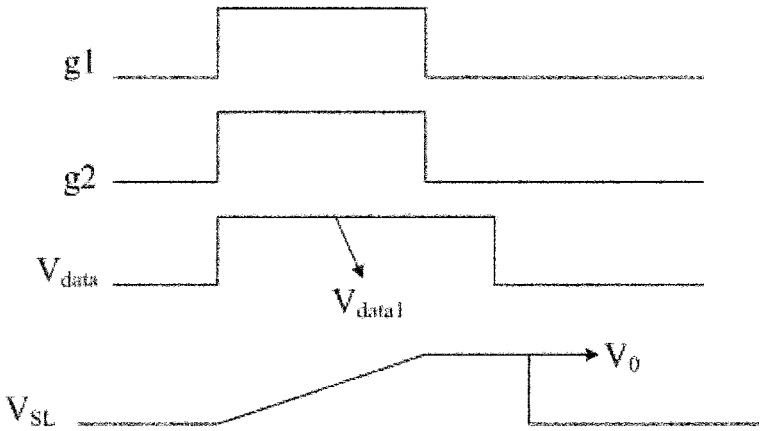
FIG. 4*a* is an exemplary timing diagram according to an embodiment of the present application.

By taking the color sub-pixels to be compensated being red sub-pixels with n=1 and K=3840 as an example, in a blanking period of a first display frame of two adjacent display frames, a data voltage $V_{data1}$ of non-zero grayscale is input to each red sub-pixel in a first row, and a pixel circuit in each red sub-pixel in the first row is controlled to operate to charge a detection line connected to the pixel circuit. An operation process of the pixel circuit charging the detection line connected to the pixel circuit will be described with reference to the pixel circuit shown in FIG. 1 and the timing diagram shown in FIG. 4*a*. In FIG. 4*a*, g1 represents a signal at a first scanning signal terminal G1, g2 represents a signal at a second scanning signal terminal G2, $V_{data}$ represents a data voltage at a data signal terminal Data, and $V_{SL}$ represents a voltage charged into a detection line. A switch transistor T2 is turned on under the control of a high potential of the signal g1 at the first scanning signal terminal G1, and a detection transistor T3 is turned on under the control of a high potential of the signal g2 at the second scanning signal terminal G2. The switch transistor T2 provides the input data voltage $V_{data1}$ to a gate of the driving transistor T1. The driving transistor T1 generates operating current I under the control of both a gate voltage and a source voltage thereof, and the operating current I satisfies the following formula: $I=K[V_{gs}-V_{th}]^2=K[V_{data1}-V_{dd}-V_{th}]^2$, wherein $V_{dd}$ represents a voltage at a high voltage power supply terminal VDD. As the OLED has a higher resistance than the detection line, the operating current I generated by the driving transistor T1 firstly flows to the detection line SL to charge the detection line SL with the detected voltage $V_0$.

By detecting the voltage $V1_{SLk_1}$ on the detection line for each red sub-pixel in the first row, $V1_{SL1_1}=V_0+\Delta V$, $V1_{SL2_1}=V_0+\Delta V$, $V1_{SL3_1}=V_0+\Delta V$, $V1_{SL4_1}=V_0\times\Delta V$, . . . $V1_{SL3839_1}=V_0+\Delta V$ and $V1_{SL3840_1}=V_0+\Delta V$ may be obtained, and the obtained 3840 voltages $V1_{SLk_1}$ may be stored.

Figure 4B:
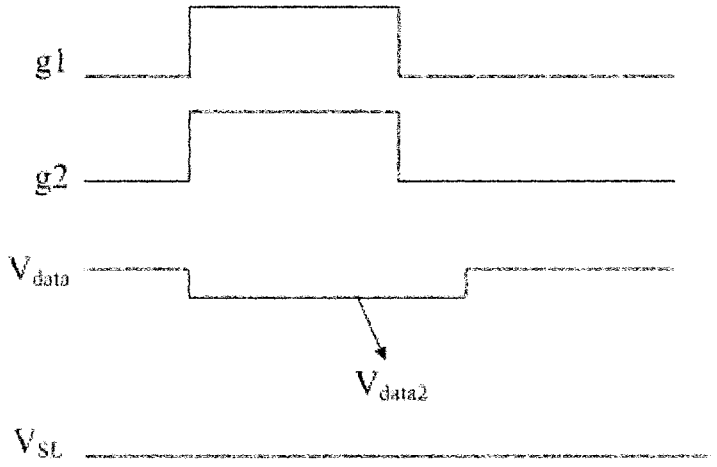
FIG. 4*b* is another exemplary timing diagram according to an embodiment of the present application.

Similarly, in a blanking period of a second display frame of two adjacent display frames, a data voltage $V_{data2}$ of zero grayscale is input to each red sub-pixel in a second row, and a pixel circuit in each red sub-pixel in the second row is controlled to operate to charge a detection line connected to the pixel circuit. An operation process of the pixel circuit charging the detection line connected to the pixel circuit will be described with reference to the pixel circuit shown in FIG. 1 and the timing diagram shown in FIG. 4*b*. In FIG. 4*b*, g1 represents a signal at a first scanning signal terminal G1, g2 represents a signal at a second scanning signal terminal G2, $V_{data}$ represents a data voltage at a data signal terminal Data, and $V_{SL}$ represents a voltage charged into a detection line. A switch transistor T2 is turned on under the control of a high potential of the signal g1 at the first scanning signal terminal G1, and a detection transistor T3 is turned on under the control of a high potential of the signal g2 at the second scanning signal terminal G2. The switch transistor T2 provides the input data voltage $V_{data2}$ to a gate of the driving transistor T1. The driving transistor T1 does not generate operating current I under the control of both a gate voltage and a source voltage thereof, so as to charge the detection line with 0V. By detecting the voltage $V2_{SLk_1}$ on the detection line for each red sub-pixel in the second row, $V2_{SL1_1}=\Delta V$, $V2_{SL2_1}=\Delta V$, $V2_{SL3_1}=\Delta V$, $V2_{SL4_1}=\Delta V$, . . . $V2_{SL3839_1}=\Delta V$ and $V2_{SL3840_1}=\Delta V$ may be obtained, and the obtained 3840 voltages $V2_{SLk_1}$ may be stored.

A voltage difference $\Delta V1_{SLk_1}$ between $V1_{SLk_1}$ and $V2_{SLk_1}$ is calculated according to the detected voltages $V1_{SLk_1}$ and $V2_{SLk_1}$ on the detection lines for the red sub-pixels in the first row and the second row and belonging to the same column, so that $\Delta V1_{SL1_1}=V1_{SL1_1}-V2_{SL1_1}=V_0$, $\Delta V1_{SL2_1}=V1_{SL2_1}-V2_{SL2_1}=V_0$, . . . $\Delta V1_{SL3839_1}=V1_{SL3839_1}-V2_{SL3839_1}=V_0$, $\Delta V1_{SL3840_1}=V1_{SL3840_1}-V2_{SL3840_1}=V_0$ are obtained. In this way, the detected voltage $V_0$ of each red sub-pixel in the first row after the decoupling voltage $\Delta V$ is eliminated may be obtained, 3840 detected voltages $V_0$ may be obtained, and the obtained 3840 detected voltages $V_0$ are stored.

For example, after 3840 detected voltages $V_0$ are obtained, a data voltage of each red sub-pixel in the first row in a display frame after a second display frame is determined according to the detected voltage of each red sub-pixel in the first row using a preset compensation algorithm. For example, according to the formula IT=CV, T represents a time taken for charging a detection line with a voltage V, C represents a capacitance value of a storage capacitor connected to the detection line, and V represents a changed voltage value after the detection line is completely charged. According to the above formula, the operating current I generated by the driving transistor may be calculated according to the detected voltage $V_0$, then a relationship between the input data voltage and a threshold voltage $V_{th}$ and mobility of the driving transistor may be obtained according to the calculated operating current I, and then the data voltage of each red sub-pixel in the first row in the display frame after the second display frame is determined and compensated according to the determined relationship between the data voltage and the threshold voltage $V_{th}$ and the mobility of the driving transistor. In this way, the compensated data voltage is used in the display frame after the second display frame for display, to improve the screen display effect.

In practical applications, the pixel compensation method described above may achieve its functions using an apparatus combining hardware and software. The display panel may also be provided with a storage capacitor which is in one-to-one correspondence with each detection line, wherein one terminal of the storage capacitor is connected to a corresponding detection line and the above apparatus combining software and hardware, and the other terminal of the storage capacitor is connected to the ground. A capacitance value C of the storage capacitor is a value which has been preset in a process of manufacturing an organic display panel, and T is a preset charging time, which is the same for each sub-pixel.

In addition, a data voltage of zero grayscale is input to each color sub-pixel to be compensated in a $(2n-1)^{th}$ row, and a data voltage of non-zero grayscale is input to each color sub-pixel to be compensated in a $(2n)^{th}$ row, so that a detection line for each color sub-pixel to be compensated in the $(2n-1)^{th}$ row and the $(2n)^{th}$ row is charged. For example, a pixel circuit in each color sub-pixel to be compensated in the $(2n-1)^{th}$ row and the $(2n)^{th}$ row is controlled in sequence to operate and charge a detection line connected to the pixel circuit. As the non-zero grayscale corresponds to remaining screens except for the darkest screen, operating current may be generated by the driving transistor in the pixel circuit, and therefore a voltage charged by the data voltage of non-zero grayscale into the detection line connected to the pixel circuit through the pixel circuit is a detected voltage $V_0$. In this way, it can be ensured that an additional detected voltage $V_0$ can be input to the detection line for each color sub-pixel to be compensated in the $(2n)^{th}$ row. Further, as the zero grayscale corresponds to the darkest screen, a data voltage of zero grayscale generally does not cause the driving transistor in the pixel circuit to generate operating current, and therefore the voltage charged by the data voltage of zero grayscale into the detection line connected to the pixel circuit through the pixel circuit is 0V. In this way, it can be ensured that no additional detected voltage $V_0$ is input to the detection line for each color sub-pixel to be compensated in the $(2n-1)^{th}$ row.

For example, determining a detected voltage of each color sub-pixel to be compensated in the row to which the non-zero grayscale is input may comprise: calculating a voltage difference between the detected voltages on the detection lines for the color sub-pixels to be compensated in the $(2n-1)^{th}$ row and the $(2n)^{th}$ row and belonging to the same column, and determining the detected voltage of each color sub-pixel to be compensated in the $(2n)^{th}$ row according to the calculated voltage difference.

By taking the color sub-pixels to be compensated being red sub-pixels with n=1 and K=3840 as an example, in a blanking period of a first display frame of two adjacent display frames, a data voltage $V_{data2}$ of zero grayscale is input to each red sub-pixel in a first row, and a pixel circuit in each red sub-pixel in the first row is controlled to operate to charge a detection line connected to the pixel circuit. An operation process of the pixel circuit charging the detection line to which the pixel circuit is connected will be described with reference to the pixel circuit shown in FIG. 1 and the timing diagram shown in FIG. 4*b*. In FIG. 4*b*, g1 represents a signal at a first scanning signal terminal G1, g2 represents a signal at a second scanning signal terminal G2, $V_{data}$ represents a data voltage at a data signal terminal Data, and $V_{SA}$ represents a voltage charged into a detection line. A switch transistor T2 is turned on under the control of a high potential of the signal g1 at the first scanning signal terminal G1, and a detection transistor T3 is turned on under the control of a high potential of the signal g2 at the second scanning signal terminal G2. The switch transistor T2 provides the input data voltage $V_{data2}$ to a gate of the driving transistor T1. The driving transistor T1 does not generate operating current I under the control of both a gate voltage and a source voltage thereof, so as to charge the detection line with 0V. By detecting the voltage $V1_{SLk_1}$ on the detection line for each red sub-pixel in the first row, $V1_{SL1_1}=\Delta V$, $V1_{SL2_1}=\Delta V$, $V1_{SL3_1}=\Delta V$, $V1_{SL4_1}=\Delta V$, . . . $V1_{SL3839_1}=\Delta V$ and $V1_{SL3840_1}=\Delta V$ may be obtained, and the obtained 3840 voltages $V1_{SLk_1}$ may be stored.

Similarly, in a blanking period of a second display frame of two adjacent display frames, a data voltage $V_{data2}$ of non-zero grayscale is input to each red sub-pixel in a second row, and a pixel circuit in each red sub-pixel in the second row is controlled to operate to charge a detection line connected to the pixel circuit. An operation process of the pixel circuit charging the detection line connected to the pixel circuit will be described with reference to the pixel circuit shown in FIG. 1 and the timing diagram shown in FIG. 4*a*. In FIG. 4*a*, g1 represents a signal at a first scanning signal terminal G1, g2 represents a signal at a second scanning signal terminal G2, $V_{data}$ represents a data voltage at a data signal terminal Data, and $V_{SL}$ represents a voltage charged into a detection line. A switch transistor T2 is turned on under the control of a high potential of the signal g1 at the first scanning signal terminal G1, and a detection transistor T3 is turned on under the control of a high potential of the signal g2 at the second scanning signal terminal G2. The switch transistor T2 provides the input data voltage $V_{data1}$ to a gate of the driving transistor T1. The driving transistor T1 generates operating current I under the control of both a gate voltage and a source voltage thereof, and the operating current I satisfies the following formula: $I=K[V_{gs}-V_{th}]^2=K[V_{data1}-V_{dd}-V_{th}]^2$, wherein $V_{dd}$ represents a voltage at a high voltage power supply terminal VDD. As the OLED has a higher resistance than the detection line, the operating current I generated by the driving transistor T1 firstly flows to the detection line SL to charge the detection line SL with the detected voltage $V_0$. By detecting the voltage $V2_{SLk_1}$ on the detection line for each red sub-pixel in the second row, $V2_{SL1_1}=V_0+\Delta V$, $V2_{SL2_1}=V_0+\Delta V$, $V2_{SL3_1}=V_0+\Delta V$, $V2_{SL4_1}=V_0+\Delta V$, . . . $V2_{SL3839_1}=V_0+\Delta v$ and $V2_{SL3840_1}=V_0+\Delta V$ may be obtained, and the obtained 3840 voltages $V2_{SLk_1}$ may be stored.

A voltage difference $\Delta V2_{SLk_1}$ between $V1_{SLk_1}$ and $V2_{SLk_1}$ is calculated according to the detected voltages $V1_{SLk_1}$ and $V2_{SLk_1}$ on the detection lines for the red sub-pixels in the first row and the second row and belonging to the same column, so that $\Delta V2_{SL1_1}=V2_{SL1_1}-V1_{SL1_1}=V_0$, $\Delta V2_{SL2_1}=V2_{SL2_1}-V1_{SL2_1}=V_0$, $\Delta V2_{SL3839_1}=V2_{SL3839_1}-V1_{SL3839_1}=V_0$, $\Delta V2_{SL3840_1}=V2_{SL3840_1}-V1_{SL3840_1}=V_0$ are obtained. In this way, the detected voltage $V_0$ corresponding to each red sub-pixel in the second row after the decoupling voltage $\Delta V$ is eliminated may be obtained, 3840 detected voltages $V_0$ may be obtained, and the obtained 3840 detected voltages $V_0$ are stored.

For example, after 3840 detected voltages $V_0$ are obtained, a data voltage of each red sub-pixel in the second row in a display frame after a second display frame may be determined according to the detected voltage of each red sub-pixel in the second row using a preset compensation algorithm. For example, according to the formula IT=CV, T represents a time taken for charging a detection line with a voltage V, C represents a capacitance value of a storage capacitor connected to the detection line, and V represents a changed voltage value after the detection line is completely charged. According to the above formula, the operating current I generated by the driving transistor may be calculated according to the detected voltage $V_0$, then a relationship between the input data voltage and a threshold voltage $V_{th}$ and mobility of the driving transistor may be obtained according to the calculated operating current I, and then the data voltage of each red sub-pixel in the second row in the display frame after the second display frame is determined and compensated according to the determined relationship between the data voltage and the threshold voltage $V_{th}$ and the mobility of the driving transistor. In this way, the compensated data voltage is used in the display frame after the second display frame for display, to improve the screen display effect.

In practical applications, the pixel compensation method described above may achieve its functions using an apparatus combining hardware and software. The display panel may also be provided with a storage capacitor which is in one-to-one correspondence with each detection line, wherein one terminal of the storage capacitor is connected to a corresponding detection line and the above apparatus combining software and hardware, and the other terminal of the storage capacitor is connected to the ground. A capacitance value C of the storage capacitor is a value which has been preset in a process of manufacturing an organic display panel, and T is a preset charging time, which is the same for each sub-pixel.

The embodiments of the present application further provide a pixel compensation apparatus of a display panel. As shown in FIGS. 2*a* and 2*b*, the display panel 10 may comprise a plurality of pixels PX and a plurality of detection lines SL_k (where k=1, 2, 3 . . . K, and K is a total number of columns of pixels in the display panel 10), each column of pixels is connected to one detection line, each pixel PX comprises a plurality of sub-pixels P_m having different colors (where m=1, 2, 3 . . . M; and M is a total number of colors of the sub-pixels in the display panel 10), and various sub-pixels P_m belonging to the same pixel PX are correspondingly connected to the same detection line.

As shown in FIGS. 2*a* and 2*b*, the pixel compensation apparatus according to the embodiments of the present application may comprise a controller 20. The controller 20 is configured to control, in blanking periods of two adjacent display frames, charging of detection lines for various color sub-pixels to be compensated in a $(2n-1)^{th}$ row and a $(2n)^{th}$ row in the display panel 10 respectively and detect voltages on various detection lines after the charging is performed, where n is a positive integer. The charging may comprise inputting a data voltage of non-zero grayscale to each color sub-pixel to be compensated in one of the $(2n-1)^{th}$ row and the $(2n)^{th}$ row, and inputting a data voltage of zero grayscale to each color sub-pixel to be compensated in the other of the $(2n-1)^{th}$ row and the $(2n)^{th}$ row.

The controller 20 is further configured to determine a detected voltage of each color sub-pixel to be compensated in the row to which the non-zero grayscale is input according to the detected voltages on detection lines for color sub-pixels to be compensated in the $(2n-1)^{th}$ row and the $(2n)^{th}$ row and belonging to the same column; and compensate for each color sub-pixel to be compensated in the row to which the non-zero grayscale is input in a next display frame according to the detected voltage.

It should be illustrated that, a size and a shape of each graphic in the above accompanying drawings do not reflect a true proportion of the display panel, and the purpose is only to illustrate the embodiments of the present application.

For example, a sub-pixel of the display panel may specifically comprise a pixel circuit and a light emitting device connected to the pixel circuit, and the pixel circuit is connected to a detection line corresponding to the sub-pixel where the pixel circuit is located. The light emitting device may be an organic light emitting diode or a quantum dot light emitting diode. Of course, the light emitting device may also be another type of electroluminescent diode capable of emitting light by itself, which is not limited here.

For example, a data voltage of non-zero grayscale may be input to each color sub-pixel to be compensated in the $(2n-1)^{th}$ row. The controller controls a pixel circuit in each color sub-pixel to be compensated in the $(2n-1)^{th}$ row and the $(2n)^{th}$ row to charge a detection line connected to the pixel circuit in sequence.

For example, the controller calculates a voltage difference between the detected voltages on the detection lines for the color sub-pixels to be compensated in the $(2n-1)^{th}$ row and the $(2n)^{th}$ row and belonging to the same column, and determines the detected voltage of each color sub-pixel to be compensated in the $(2n-1)^{th}$ row according to the calculated voltage difference.

For example, a data voltage of non-zero grayscale may be input to each color sub-pixel to be compensated in the $(2n)^{th}$ row. The controller controls a pixel circuit in each color sub-pixel to be compensated in the $(2n-1)^{th}$ row and the $(2n)^{th}$ row to charge a detection line connected to the pixel circuit in sequence.

For example, the controller is configured to calculate a voltage difference between the detected voltages on the detection lines for the color sub-pixels to be compensated in the $(2n-1)^{th}$ row and the $(2n)^{th}$ row and belonging to the same column, and determine the detected voltage of each color sub-pixel to be compensated in the $(2n)^{th}$ row according to the calculated voltage difference.

For example, the controller may be configured to implement a function of an analog-to-digital converter. Specific functions of the analog-to-digital converter can be understood by those skilled in the art, and will not be described in detail here.

For example, the pixel compensation apparatus according to the embodiments of the present application may further comprise: a first storage unit configured to store the detected voltage on the detection line for each color sub-pixel to be compensated in the $(2n-1)^{th}$ row;

a second storage unit configured to store the detected voltage on the detection line for each color sub-pixel to be compensated in the $(2n)^{th}$ row; and a third storage unit configured to store the determined detected voltage of each color sub-pixel to be compensated in the row to which the non-zero grayscale is input.

In the pixel compensation apparatus according to the embodiments of the present application, the first storage unit may comprise a first memory, which may implement a storage function in a manner of a combination of software and hardware. The second storage unit may comprise a second memory, which may implement a storage function in a manner of a combination of software and hardware. The third storage unit may comprise a third memory, which may implement a storage function in a manner of a combination of software and hardware. Of course, the first storage unit, the second storage unit, and the third storage unit may all be provided in a memory combining software and hardware to achieve high integration.

For example, the controller is further configured to determine a data voltage of each color sub-pixel to be compensated in the row to which the non-zero grayscale is input in a display frame after a $(2n)^{th}$ display frame using a preset compensation algorithm according to the detected voltage of each color sub-pixel to be compensated in the row to which the non-zero grayscale is input. The preset compensation algorithm can be understood by those skilled in the art, which will not be described in detail here.

For example, the display panel further comprises a source driving circuit. The controller provides the determined data voltage of each color sub-pixel to be compensated in the row to which the non-zero grayscale is input in the display frame after the $(2n)^{th}$ display frame to the source driving circuit, and controls the source driving circuit to input the determined data voltage into a corresponding sub-pixel in the display frame after the $(2n)^{th}$ display frame. In this way, threshold voltages and mobility of the driving transistors in the pixel circuits of the sub-pixels are compensated.

For example, the controller may be implemented as a data processor. The data processor can implement a function thereof in manner of a combination of software and hardware. Further, a specific structure of the data processor may be the same as a general structure, which can be understood by those skilled in the art, and will not be described in detail here.

The display panel may comprise N rows of sub-pixels, where N is an even number. Then, the $(2n-1)^{th}$ row is an odd-numbered row of sub-pixels, and the $(2n)^{th}$ row is an even-numbered row of sub-pixels, where $$n = 1, 2, 3, \ldots \frac{N}{2}.$$

For example, n=1, 2, and 3 when N=6; or n=1, 2, 3, 4, and 5 when N=10; and so on when n is equal to another value, which will not be repeated here.

When the display panel comprises N rows of sub-pixels, the pixel compensation according to the embodiments of the present application may be performed in 2N consecutive display frames. In a blanking period of a $(2n-1)^{th}$ display frame in first N consecutive display frames of the 2N consecutive display frames, a data voltage of non-zero grayscale is input to each color sub-pixel to be compensated in a $(2n-1)^{th}$ row, and in a blanking period of a $(2n)^{th}$ display frame in the first N consecutive display frames, a data voltage of zero grayscale is input to each color sub-pixel to be compensated in a $(2n)^{th}$ row. In a blanking period of a $(2n-1)^{th}$ display frame in last N consecutive display frames of the 2N consecutive display frames, a data voltage of zero grayscale is input to each color sub-pixel to be compensated in the $(2n-1)^{th}$ row, and in a blanking period of a $(2n)^{th}$ display frame in the last N consecutive display frames, a data voltage of non-zero grayscale is input to each color sub-pixel to be compensated in the $(2n)^{th}$ row.

Alternatively, in the blanking period of the $(2n-1)^{th}$ display frame in the first N consecutive display frames of the 2N consecutive display frames, a data voltage of zero grayscale is input to each color sub-pixel to be compensated in the $(2n-1)^{th}$ row, and in the blanking period of the $(2n)^{th}$ display frame in the first N consecutive display frames, a data voltage of non-zero grayscale may be input to each color sub-pixel to be compensated in the $(2n)^{th}$ row. In the blanking period of the $(2n-1)^{th}$ display frame in the last N consecutive display frames of the 2N consecutive display frames, a data voltage of non-zero grayscale is input to each color sub-pixel to be compensated in the $(2n-1)^{th}$ row, and in the blanking period of the $(2n)^{th}$ display frame in the last N consecutive display frames, a data voltage of zero grayscale is input to each color sub-pixel to be compensated in the $(2n)^{th}$ row.

When there are M colors of sub-pixels in the display panel, compensation phases of which a number is the same as a total number of the colors may be included. For example, when M=1, only one compensation phase may be included. When M=2, two compensation phases may be included, and display frames in the two compensation phases are consecutive, that is, a last display frame of a first compensation phase in the two compensation phases and a first display frame of a second compensation phase in the two compensation phases are consecutive. When M=3, three compensation phases may be included, and display frames in the three compensation phases are consecutive, that is, a last display frame of a first compensation phase in the three compensation phases and a first display frame of a second compensation phase in the three compensation phases are consecutive, and a last display frame of a second compensation phase in the three compensation phases and a first display frame of a third compensation phase in the three compensation phases are consecutive. When M=4, four compensation phases may be included, and display frames in the four compensation phases are consecutive, that is, a last display frame of a first compensation phase in the four compensation phases and a first display frame of a second compensation phase in the four compensation phases are consecutive, a last display frame of a second compensation phase in the four compensation phases and a first display frame of a third compensation phase in the four compensation phases are consecutive, and a last display frame of a third compensation phase in the four compensation phases and a first display frame of a fourth compensation phase in the four compensation phases are consecutive. When M is equal to another value, a relationship among the display frames may be deduced similarly, which will not be repeated here.

For example, the display panel may be a high resolution display panel. The high resolution may comprise 3840×2160, 1920×1080, etc., which is not limited here.

As shown in FIG. 2*a*, for example, the display panel may comprise a red sub-pixel P_1, a green sub-pixel P_2, and a blue sub-pixel P_3. Three compensation phases arranged in order may be included, and each of the compensation phases corresponds to one of the red sub-pixel P_1, the green sub-pixel P_2, and the blue sub-pixel P_3. The color sub-pixels to be compensated in the three compensation phases may be the red sub-pixel P_1, the green sub-pixel P_2, and the blue sub-pixel P_3 in sequence, so that threshold voltages of driving transistors in the sub-pixels may be compensated in sequence in an order of red, green, and blue. Alternatively, the threshold voltages of the driving transistors in the sub-pixels may also be compensated in an order of red, blue, and green. Alternatively, the threshold voltages of the driving transistors in the sub-pixels may also be compensated in an order of green, red, and blue. Of course, color sub-pixels to be compensated in the three compensation phases may also be in an order other than the order of the red sub-pixel P_1, the green sub-pixel P_2, and the blue sub-pixel P_3, which will not be described in detail here.

As shown in FIG. 2*b*, the display panel may comprise a red sub-pixel P_1, a green sub-pixel P_2, a blue sub-pixel P_3, and a white sub-pixel P_4. Four compensation phases arranged in order may be included, and each of the compensation phases corresponds to one of the red sub-pixel P_1, the green sub-pixel P_2, the blue sub-pixel P_3, and the white sub-pixel P_4. The color sub-pixels to be compensated in the four compensation phases may be the red sub-pixel P_1, the green sub-pixel P_2, the blue sub-pixel P_3, and the white sub-pixel P_4 in sequence, so that threshold voltages of driving transistors in the sub-pixels may be compensated in the display panel in an order of red, green, blue, and white. Alternatively, the threshold voltages of the driving transistors in the sub-pixels may also be compensated in an order of red, blue, green, and white. Alternatively, the threshold voltages of the driving transistors in the sub-pixels may also be compensated in an order of green, red, blue and white. Of course, the color sub-pixels to be compensated in the four preset color compensation phases may also be an order other than the order of the red sub-pixel P_1, the green sub-pixel P_2, the blue sub-pixel P_3, and the white sub-pixel P_4, which will not be described in detail here.

The embodiments of the present application further provide a display apparatus comprising the pixel compensation apparatus according to the embodiments of the present application. Implementations of the display apparatus can be known with reference to the above-mentioned embodiments of the pixel compensation apparatus, and the repeated description is omitted.

The display apparatus according to the embodiments of the present application further comprises a display panel. The display panel may be an electroluminescent display panel, such as an organic light emitting diode display panel or a quantum dot light emitting display panel, which is not limited here.

In a specific implementation, the display apparatus according to the embodiments of the present application may be any product or component having a display function such as a mobile phone, a tablet computer, a television, a display, a notebook computer, a digital photo frame, a navigator, etc. Other indispensable components for the display apparatus should be understood by those of ordinary skill in the art and are not described in detail here, and should not be taken as limiting the present application.

It will be apparent to those skilled in the art that various modifications and variations can be made in the present application without departing from the spirit and scope of the present application. If these modifications and variations of the present application fall within the scope of the appended claims and their equivalents, the present application also intends to include these modifications and variations.

We claim:

1. A pixel compensation apparatus of a display panel, comprising a controller configured to:

control, in blanking periods of two adjacent display frames, charging of detection lines for various color sub-pixels to be compensated in a $(2n-1)^{th}$ row and a $(2n)^{th}$ row in the display panel respectively and detect voltages on various detection lines after the charging is performed, where n is a positive integer; wherein the charging comprises inputting a data voltage of non-zero grayscale to each color sub-pixel to be compensated in one of the $(2n-1)^{th}$ row and the $(2n)^{th}$ row, and inputting a data voltage of zero grayscale to each color sub-pixel to be compensated in the other of the $(2n-1)^{th}$ row and the $(2n)^{th}$ row;

determine a detected voltage of each color sub-pixel to be compensated in the row to which the non-zero grayscale is input according to the detected voltages on detection lines for color sub-pixels to be compensated in the $(2n-1)^{th}$ row and the $(2n)^{th}$ row and belonging to the same column; and compensate for each color sub-pixel to be compensated in the row to which the non-zero grayscale is input in a next display frame according to the detected voltage.

2. The pixel compensation apparatus according to claim 1, wherein each sub-pixel comprises a pixel circuit and a light emitting device connected to the pixel circuit, and the pixel circuit is connected to a corresponding detection line; and the controller is further configured to control the pixel circuit to input the data voltage of non-zero grayscale to the color sub-pixel to be compensated in the $(2n-1)^{th}$ row to charge a detection line connected to the pixel circuit.

3. The pixel compensation apparatus according to claim 2, wherein the controller is further configured to calculate a voltage difference between the detected voltages on the detection lines for the color sub-pixels to be compensated in the $(2n-1)^{th}$ row and the $(2n)^{th}$ row and belonging to the same column, and determine the detected voltage of each color sub-pixel to be compensated in the $(2n-1)^{th}$ row according to the calculated voltage difference.

4. The pixel compensation apparatus according to claim 1, wherein each sub-pixel comprises a pixel circuit and a light emitting device connected to the pixel circuit, and the pixel circuit is connected to a corresponding detection line; and the controller is further configured to control the pixel circuit to input the data voltage of non-zero grayscale to the color sub-pixel to be compensated in the $(2n)^{th}$ row to charge a detection line connected to the pixel circuit.

5. The pixel compensation apparatus according to claim 4, wherein the controller is further configured to calculate a voltage difference between the detected voltages on the detection lines for the color sub-pixels to be compensated in the $(2n-1)^{th}$ row and the $(2n)^{th}$ row and belonging to the same column, and determine the detected voltage of each color sub-pixel to be compensated in the $(2n)^{th}$ row according to the calculated voltage difference.

6. The pixel compensation apparatus according to claim 1, wherein the display panel comprises a red sub-pixel, a green sub-pixel, and a blue sub-pixel, and the controller is configured to compensate for one of the red sub-pixel, the green sub-pixel, and the blue sub-pixel respectively.

7. The pixel compensation apparatus according to claim 1, wherein the display panel comprises a red sub-pixel, a green sub-pixel, a blue sub-pixel, and a white sub-pixel, and the controller is configured to compensate for one of the red sub-pixel, the green sub-pixel, the blue sub-pixel, and the white sub-pixel respectively.

8. The pixel compensation apparatus according to claim 6, wherein the controller is configured to compensate for the red sub-pixel, the green sub-pixel, and the blue sub-pixel in sequence.

9. The pixel compensation apparatus according to claim 7, wherein the controller is configured to compensate for the red sub-pixel, the green sub-pixel, the blue sub-pixel, and the white sub-pixel in sequence.

10. A display apparatus, comprising the pixel compensation apparatus according to claim 1.

11. A pixel compensation method of a display panel, comprising:

charging, in blanking periods of two adjacent display frames, detection lines for various color sub-pixels to be compensated in a $(2n-1)^{th}$ row and a $(2n)^{th}$ row in the display panel respectively and detecting voltages on various detection lines after the charging is performed, where n is a positive integer; wherein the charging comprises inputting a data voltage of non-zero grayscale to each color sub-pixel to be compensated in one of the $(2n-1)^{th}$ row and the $(2n)^{th}$ row, and inputting a data voltage of zero grayscale to each color sub-pixel to be compensated in the other of the $(2n-1)^{th}$ row and the $(2n)^{th}$ row;

determining a detected voltage of each color sub-pixel to be compensated in the row to which the non-zero grayscale is input according to the detected voltages on detection lines for color sub-pixels to be compensated in the $(2n-1)^{th}$ row and the $(2n)^{th}$ row and belonging to the same column; and compensating for each color sub-pixel to be compensated in the row to which the non-zero grayscale is input in a next display frame according to the detected voltage.

12. The pixel compensation method according to claim 11, wherein each sub-pixel comprises a pixel circuit and a light emitting device connected to the pixel circuit, and the pixel circuit is connected to a corresponding detection line; and charging detection lines for various color sub-pixels to be compensated in a $(2n-1)^{th}$ row and a $(2n)^{th}$ row comprises: controlling a pixel circuit in each color sub-pixel to be compensated in the $(2n-1)^{th}$ row to input the data voltage of non-zero grayscale to the color sub-pixel to be compensated in the $(2n-1)^{th}$ row.

13. The pixel compensation method according to claim 12, wherein determining a detected voltage of each color sub-pixel to be compensated in the row to which the non-zero grayscale is input comprises: calculating a voltage difference between the detected voltages on the detection lines for the color sub-pixels to be compensated in the $(2n-1)^{th}$ row and the $(2n)^{th}$ row and belonging to the same column, and determining the detected voltage of each color sub-pixel to be compensated in the $(2n-1)^{th}$ row according to the calculated voltage difference.

14. The pixel compensation method according to claim 11, wherein each sub-pixel comprises a pixel circuit and a light emitting device connected to the pixel circuit, and the pixel circuit is connected to a corresponding detection line; and charging detection lines for various color sub-pixels to be compensated in a $(2n-1)^{th}$ row and a $(2n)^{th}$ row comprises: controlling a pixel circuit in each color sub-pixel to be compensated in the $(2n)^{th}$ row to input the data voltage of non-zero grayscale to the color sub-pixel to be compensated in the $(2n)^{th}$ row.

15. The pixel compensation method according to claim 14, wherein determining a detected voltage of each color sub-pixel to be compensated in the row to which the non-zero grayscale is input comprises: calculating a voltage difference between the detected voltages on the detection lines for the color sub-pixels to be compensated in the $(2n-1)^{th}$ row and the $(2n)^{th}$ row and belonging to the same column, and determining the detected voltage of each color sub-pixel to be compensated in the $(2n)^{th}$ row according to the calculated voltage difference.

16. The pixel compensation method according to claim 11, wherein the display panel comprises a red sub-pixel, a green sub-pixel, and a blue sub-pixel, and the method comprises: compensating for one of the red sub-pixel, the green sub-pixel, and the blue sub-pixel respectively.

17. The pixel compensation method according to claim 11, wherein the display panel comprises a red sub-pixel, a green sub-pixel, a blue sub-pixel, and a white sub-pixel, and the method comprises: compensating for one of the red sub-pixel, the green sub-pixel, the blue sub-pixel, and the white sub-pixel respectively.

18. The pixel compensation method according to claim 16, wherein the red sub-pixel, the green sub-pixel, and the blue sub-pixel are compensated in sequence.

19. The pixel compensation method according to claim 17, wherein the red sub-pixel, the green sub-pixel, the blue sub-pixel, and the white sub-pixel are compensated in sequence.

* * * * *